US007699250B1

(12) United States Patent
Jones

(10) Patent No.: US 7,699,250 B1
(45) Date of Patent: Apr. 20, 2010

(54) MEDIA GRINDING MILL

(75) Inventor: Donald W. Jones, Equality, AL (US)

(73) Assignee: Progressive Industries, Inc., Sylacauga, AL (US)

( * ) Notice: Subject to any disclaimer, the term of this patent is extended or adjusted under 35 U.S.C. 154(b) by 80 days.

(21) Appl. No.: 12/041,012

(22) Filed: Mar. 3, 2008

Related U.S. Application Data

(60) Provisional application No. 60/904,553, filed on Mar. 2, 2007.

(51) Int. Cl.
*B02C 17/16* (2006.01)

(52) U.S. Cl. ..... 241/30; 241/57; 241/65; 241/172; 241/179

(58) Field of Classification Search ..... 241/172, 241/30, 65, 57, 21, 179, 180
See application file for complete search history.

(56) References Cited

U.S. PATENT DOCUMENTS 4,629,133 A * 12/1986 Buhler ..... 241/46.11
4,966,331 A * 10/1990 Maier et al. ..... 241/172
5,950,943 A * 9/1999 Stehr ..... 241/171
6,585,180 B2 * 7/2003 Inoue ..... 241/171

FOREIGN PATENT DOCUMENTS

DE 34311142 * 3/1986
EP 0504836 * 3/1992

OTHER PUBLICATIONS

"DE 3431142, English translation of German language published patent application", prepared Aug. 31, 2009.

* cited by examiner

*Primary Examiner*—Mark Rosenbaum
(74) *Attorney, Agent, or Firm*—Kilpatrick Stockton LLP; John S. Pratt

(57) ABSTRACT

A media grinding mill having a grinding chamber in the shape of a donut or torus within which at least one plow travels along a circular path typically creating one or more pressure regions between the plow and the grinding chamber walls that facilitates the grinding operation. Optional guide vanes positioned on the plows can further control the grinding process.

19 Claims, 9 Drawing Sheets

MEDIA GRINDING MILL

CROSS-REFERENCE TO RELATED APPLICATION

This application claims the benefit of U.S. Provisional Application No. 60/904,553 filed Mar. 2, 2007, which is incorporated herein by this reference.

FIELD OF THE INVENTION

This invention relates to media mills for grinding materials like calcium carbonate.

BACKGROUND OF THE INVENTION

Many types of media mills exist that use grinding media of various sizes in a generally round grinding pot or chamber. Such mills have a rotating shaft that extends down into the grinding chamber to which horizontal bars or paddles are fixed to stir, or agitate, the media and material to be ground. Existing media mills rely solely on the weight of the media and agitation action from the rotating center shaft with bars or paddles for agitation of the media to grind a given feed.

SUMMARY OF THE INVENTION

The grinding mill of this invention utilizes a grinding chamber having chamber walls relatively close together and paddles or plows with optional vanes or wedges that travel between the chamber walls. Pressure regions within the grinding media and material between the paddles and or structures attached to the paddles and the grinding chamber walls and or floor or ceiling contribute to the grinding behavior and characteristics. Various structures and dimensions can be used to achieve the described grinding chamber and plow geometry and relationships. Relatively wide plows oriented in alignment with or at an angle to the direction of plow travel may be used, as may various vanes, wedges and other structures attached to the plow or plows. Grinding troughs of this invention can be configured in a variety of shapes, including elongated troughs and donut, torus, and round tube-within-a-tube shapes.

DESCRIPTION OF THE INVENTION AND DRAWINGS

Figure 4:
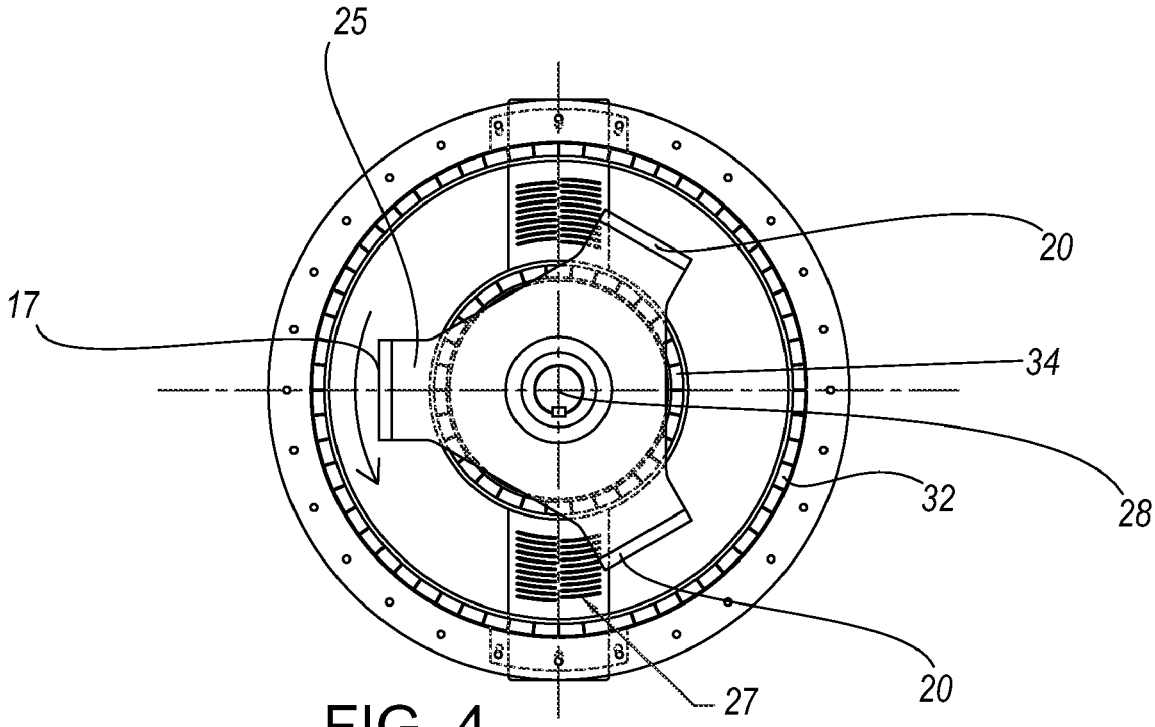
FIG. 4 is a top view of the trough and plow hub of the mill of this invention.

The grinding chamber for the trough mill 10 of this invention resembles a tube cake pan or Bundt cake pan with a center. Chamber 11 has an inner wall 12 in the form of a column or tube and a larger diameter outer wall 14 connected to the inner wall 12 at the bottom 16. The space 18 between the inner wall and the outer wall forms a continuous or endless doughnut-shaped trough within chamber 11 for grinding media and material to be ground. The inner and outer walls 14 and 16 may be vertical or may slope or have other configurations. An adjustable discharge grate 27 may be positioned on the top of the mill as shown in FIG. 4.

The trough mill 10 of this invention adds another dimension to the grinding process. Broad face grinding plows 20 are connected to a spider 25 that is in turn attached to a hub 21 that rotates about a central axis 28, thereby rotating the grinding plows 20 continuously around in the grinding trough 23 between the trough inner and outer walls 12 and 14. As the broad face plows 20 travel in the circular trough 18, they not only agitate the media, but also introduce compression to the grinding process. This pressure dramatically increases the grinding on both hard and soft materials, since speed or weight of the media are no longer the limiting conditions.

Figure 1:
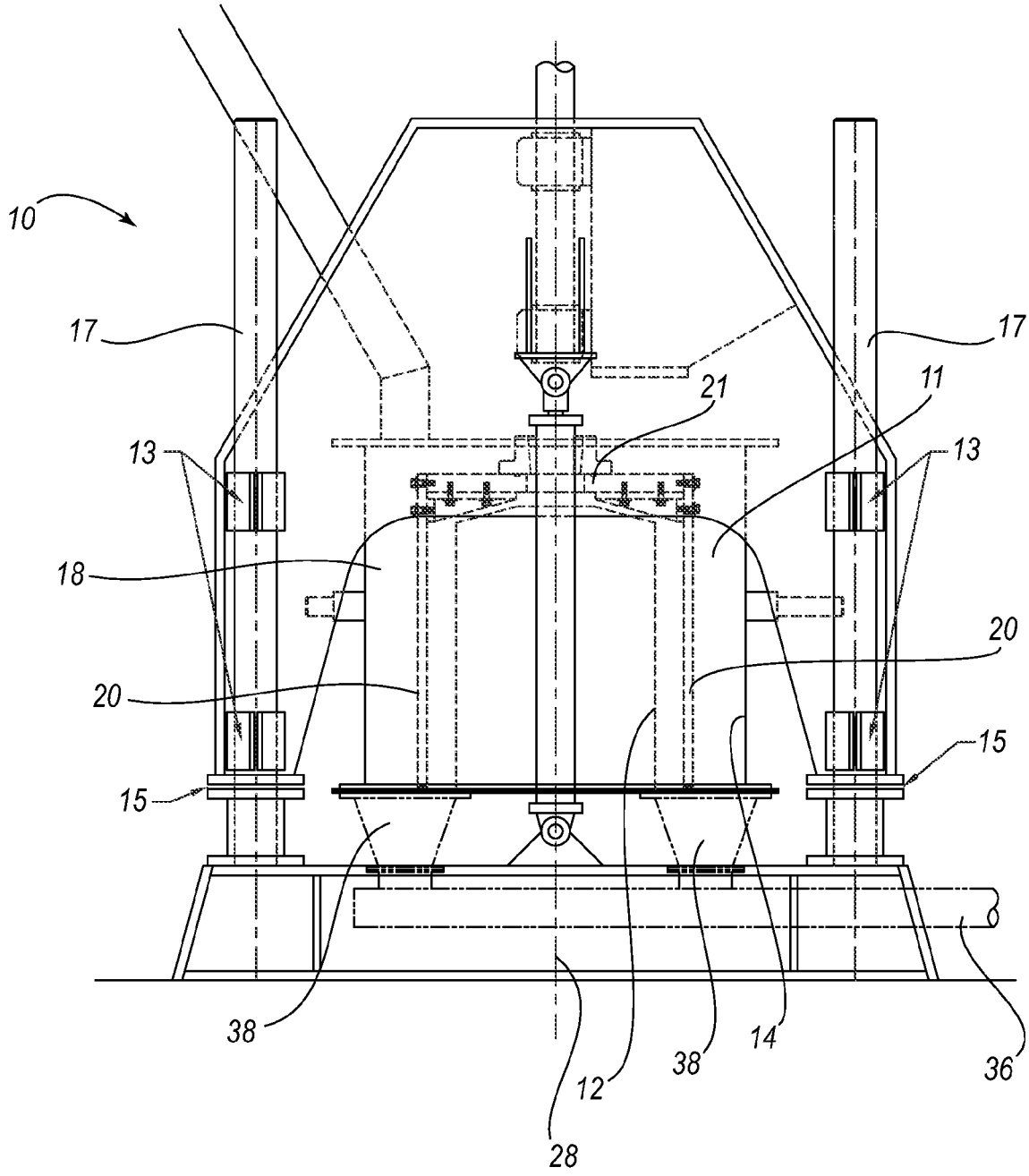
FIG. 1 is a schematic side view of the grinding mill of this invention.
Figure 2:
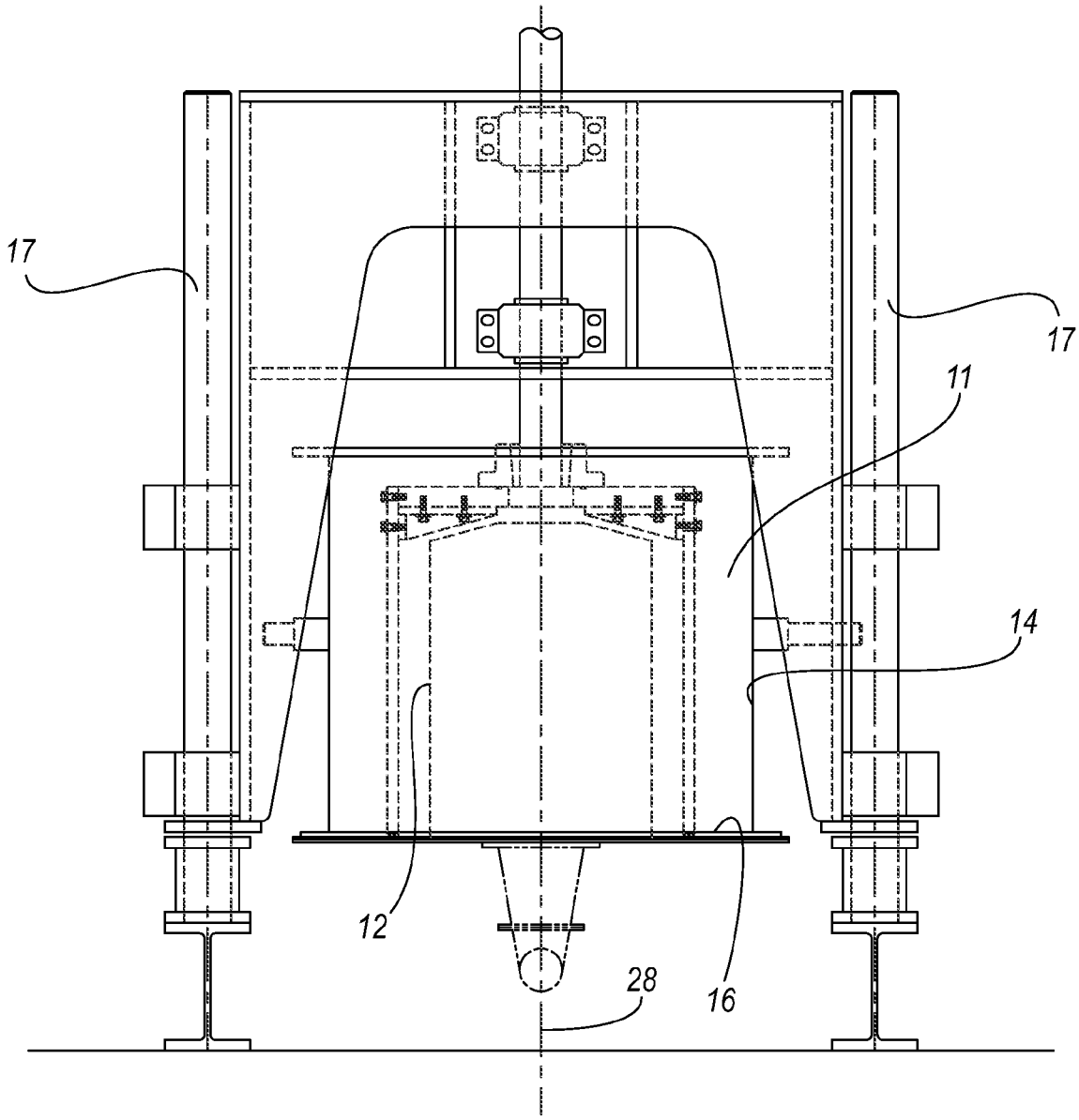
FIG. 2 is another schematic side view of the grinding mill of this invention with the mill rotated 90 degrees from the view shown in FIG. 1.

The overall assembly drawings, FIGS. 1 and 2, show mounting the trough mill 10 on four posts 17 with clamps 13 and shim packs 15. The entire drive assembly is raised and lowered by two hydraulic cylinders (not shown). The drive assembly is raised up until the broad face plows 20 clear the media charge in trough 18 in order to change the plows 20. The plow 20 clearance at the bottom 16 of trough 18 between the tip of the plow and the bottom 16, is adjusted by adding or removing shims from the shim packs 15.

Figure 3:
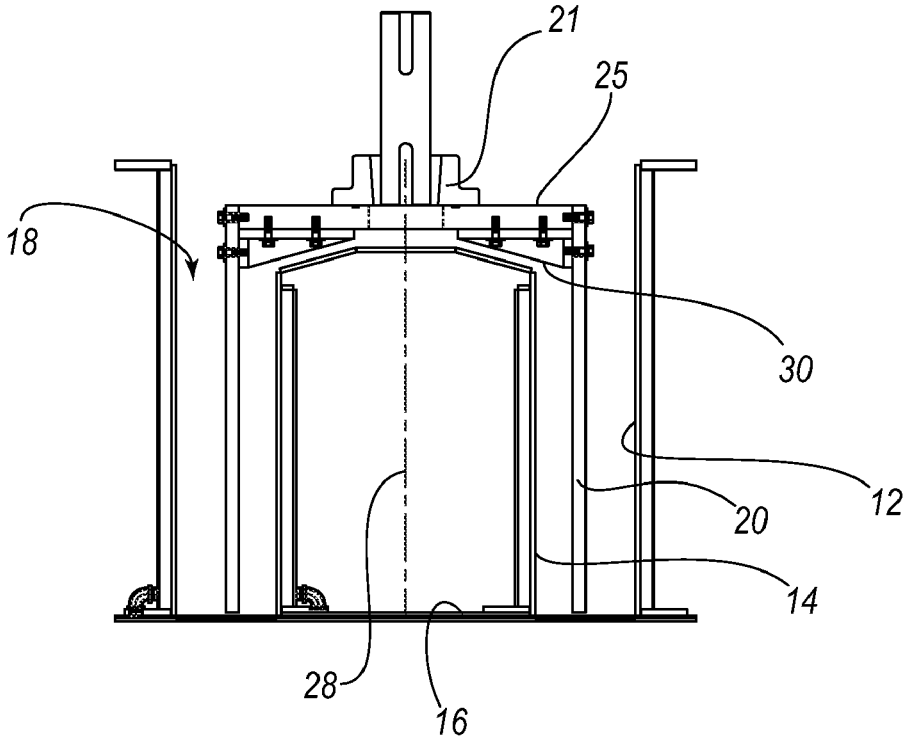
FIG. 3 is a simplified side view in section of the mill of this invention.

One embodiment of the mill 10 of this invention (illustrated in FIGS. 1, 2 and 3) is equipped with three broad face grinding plows 20; however, other trough mills of this invention may have as few as two or up to six or more grinding plows. The desired compression occurs as the broad face grinding plow 20, which is straight, travels through the circular trough 18.

Figure 5:
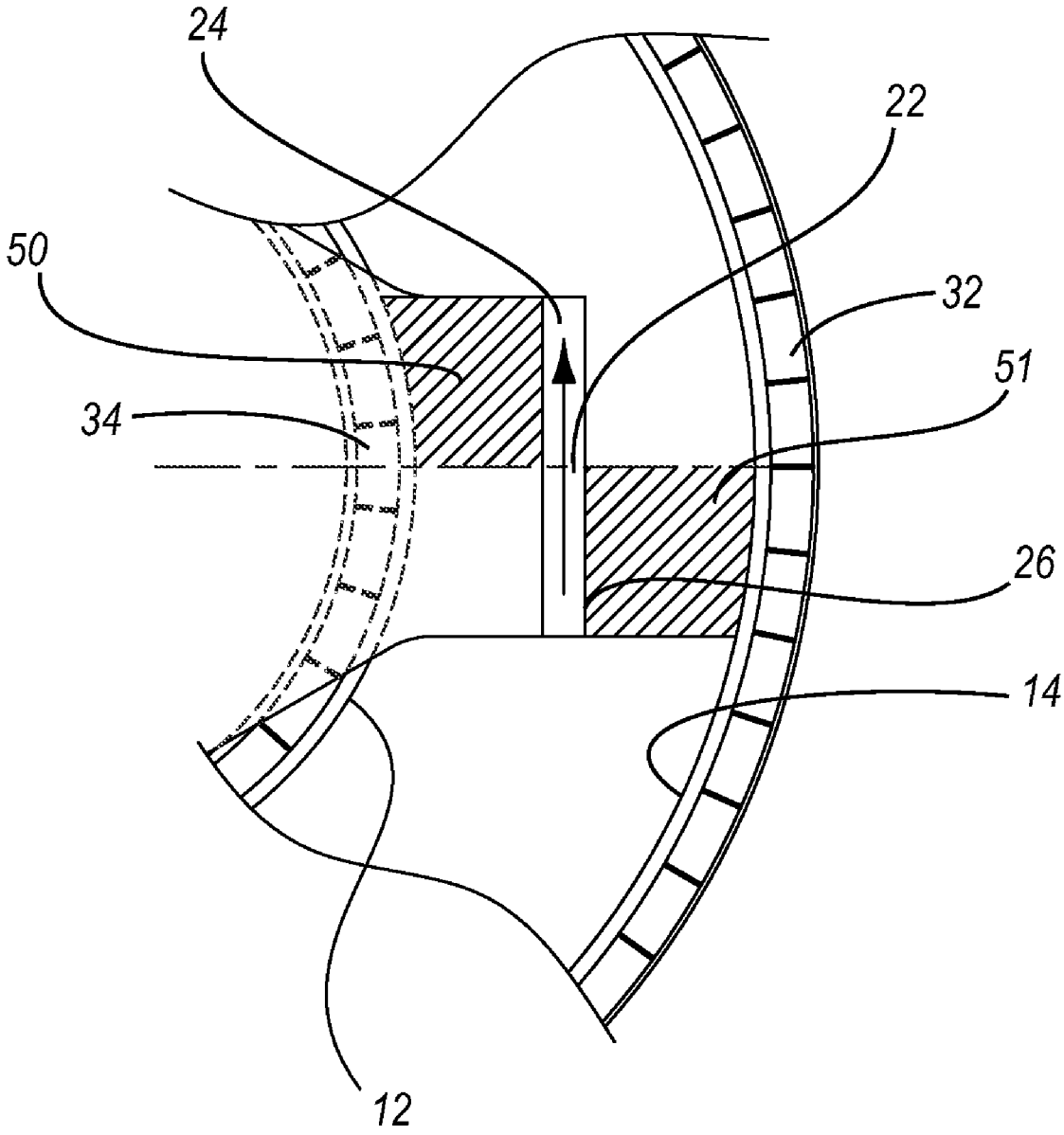
FIG. 5 is a top view of a portion of the trough of the mill of this invention showing pressure regions established by rotation of a plow.

As may be appreciated by reference to FIG. 5, if a plow 20 is positioned square to the central axis of rotation of the plows 20 (i.e., if the face of the plow 20 is at right angles to radii passing through the axis of rotation), areas of compression 50 and 51 will be created on each side of the plow 20. The leading edge 24 of the grinding plow 20 is farther away from the inner grinding chamber wall 12 than is the center 22 of the plow 20. The center 22 of the grinding plow 20 is farther away from the outer chamber wall 14 than the trailing edge 26 of the grinding plow 20. As is illustrated in FIG. 5, movement of each plow 20 through the chamber 18 pushes media and material forward and compresses it against the chamber walls 12 and 14.

Figure 6:
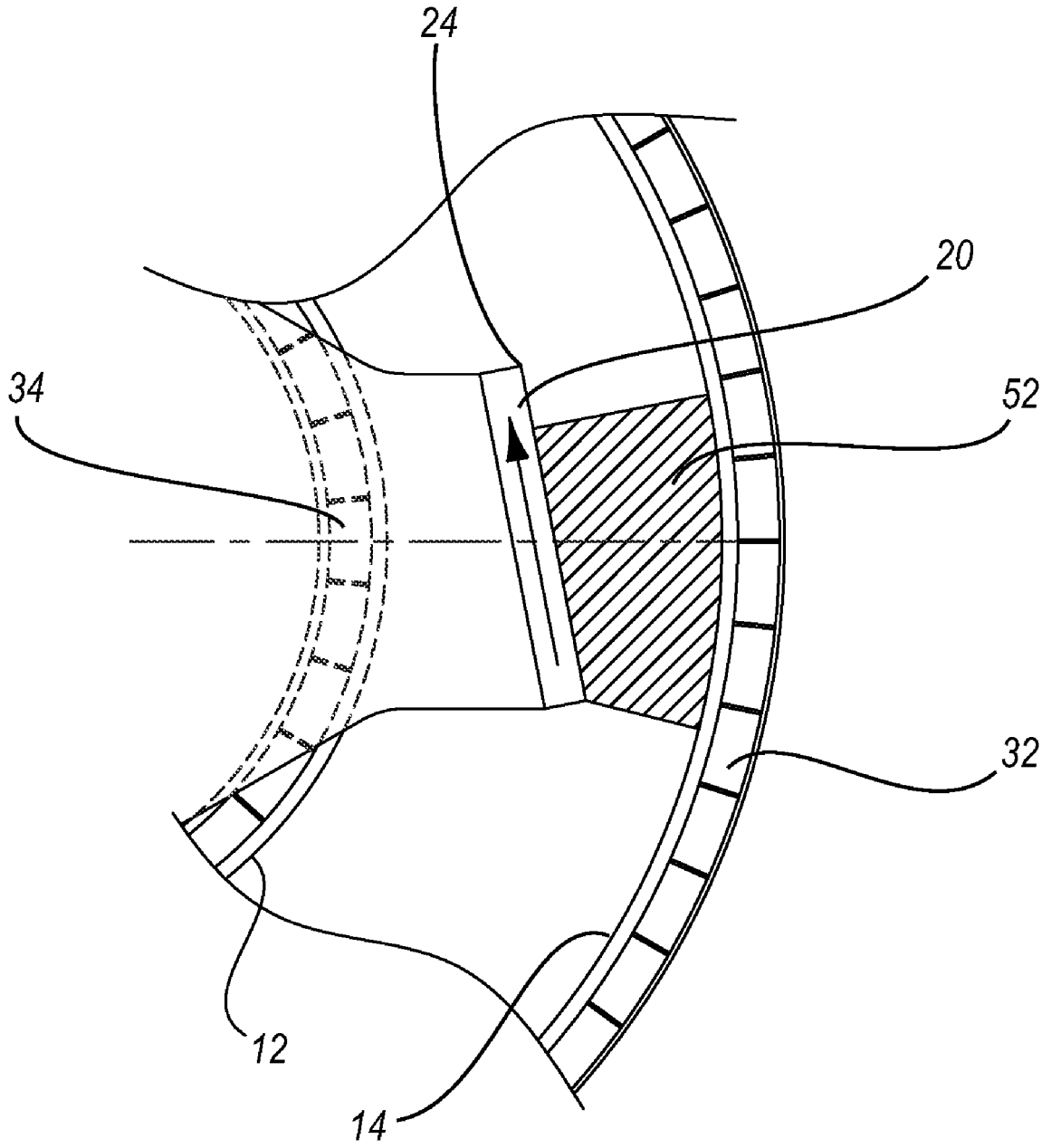
FIG. 6 is a top view similar to FIG. 5 with a differently positioned plow.
Figure 7:
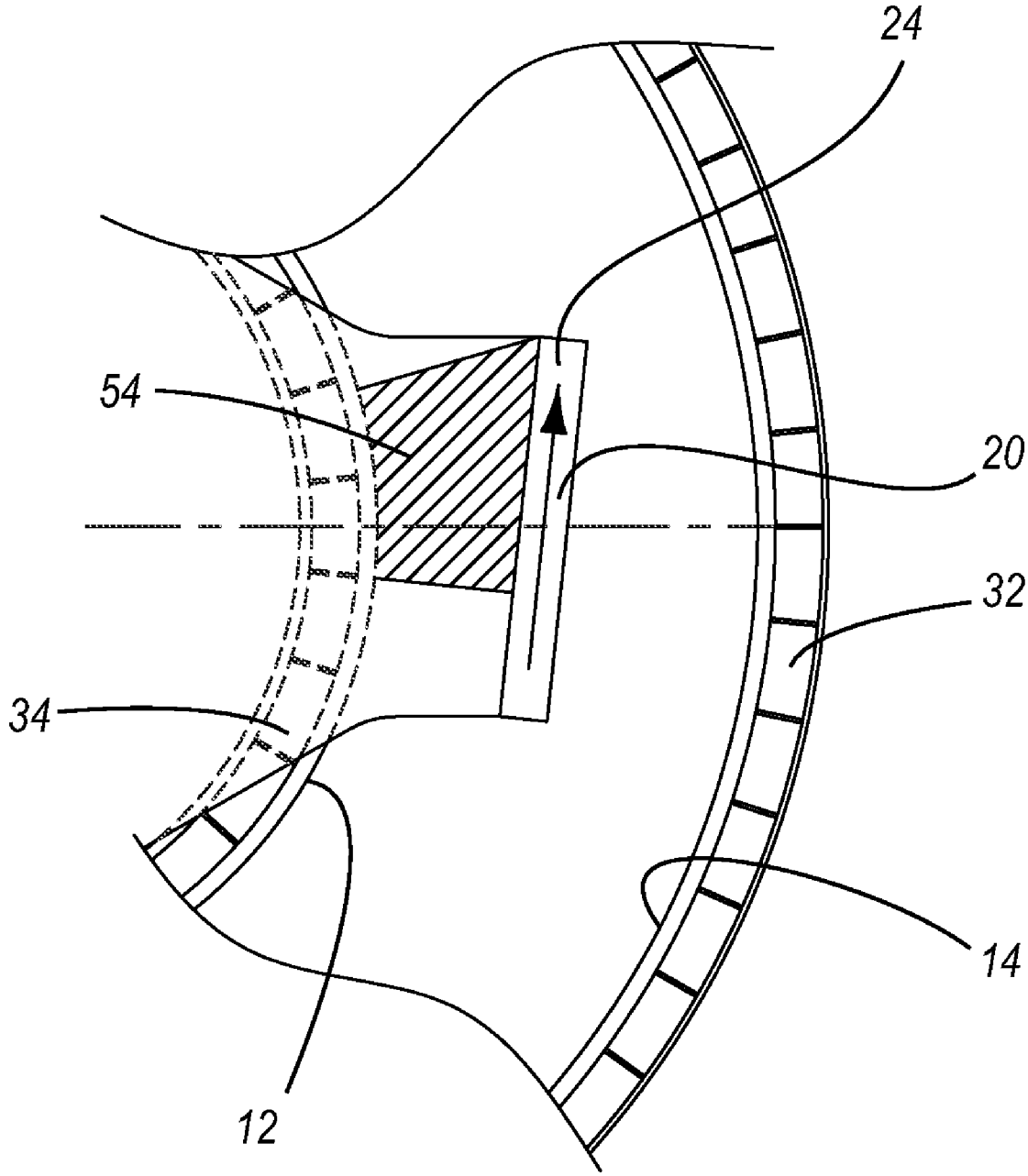
FIG. 7 is a top view similar to FIG. 5 with a second differently positioned plow.
Figure 8:
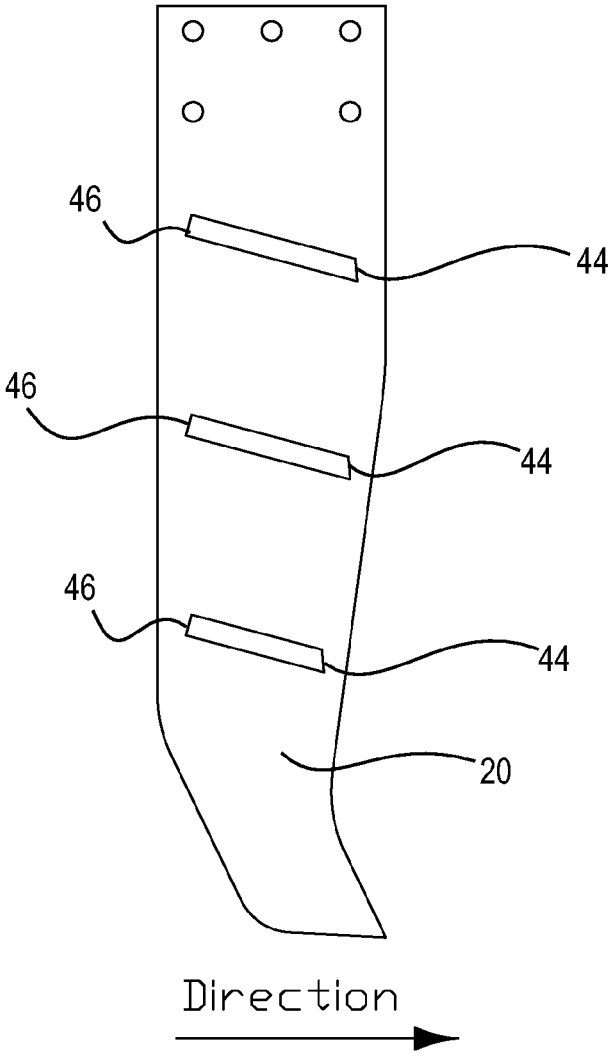
FIG. 8 is a side view of one plow of this invention with downward facing vanes.
Figure 9:
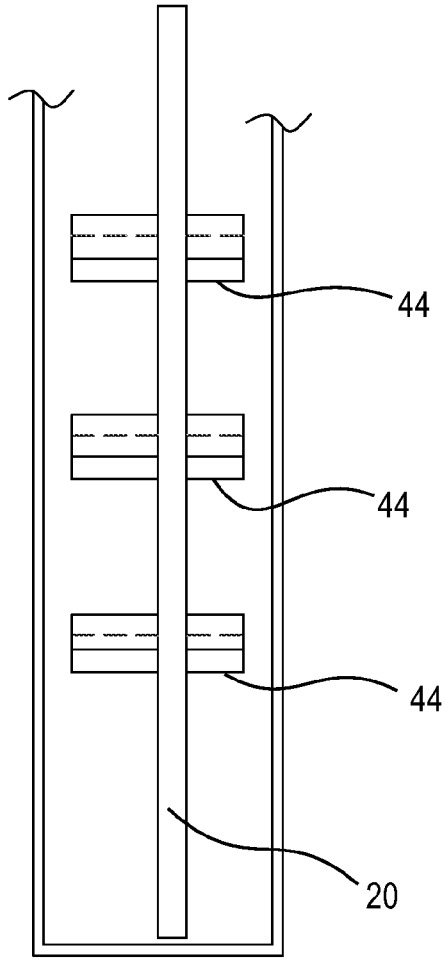
FIG. 9 is side view of the plow of FIG. 8 positioned in a cross section view of the trough.

FIGS. 6 and 7 illustrate alternatively positioned plows 20 that are "rotated." The leading edge 24 is positioned nearer the center of rotation 28 in FIG. 6 (herein termed "the leading edge is rotated in"), thereby producing a compression region 52 between the plow 20 and outer wall 14. The leading edge 24 is positioned further from the center of rotation in FIG. 7 (herein termed "the leading edge is rotated out"), thereby producing a compression region 54 between the plow 20 and the inner wall 12.

Figure 10:
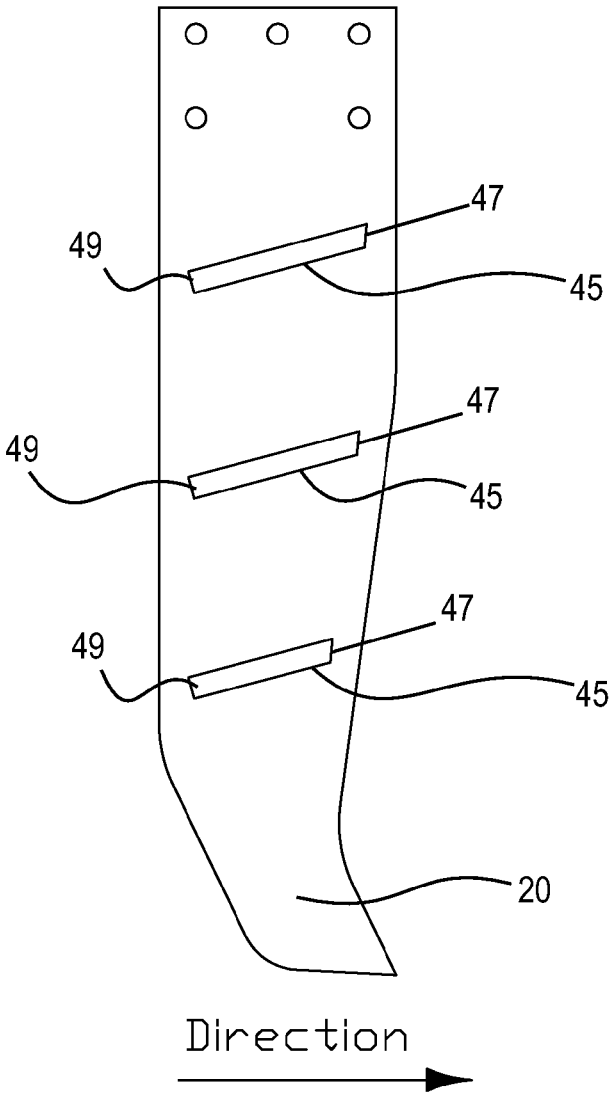
FIG. 10 is a side view of one plow of this invention with upward facing vanes.
Figure 11:
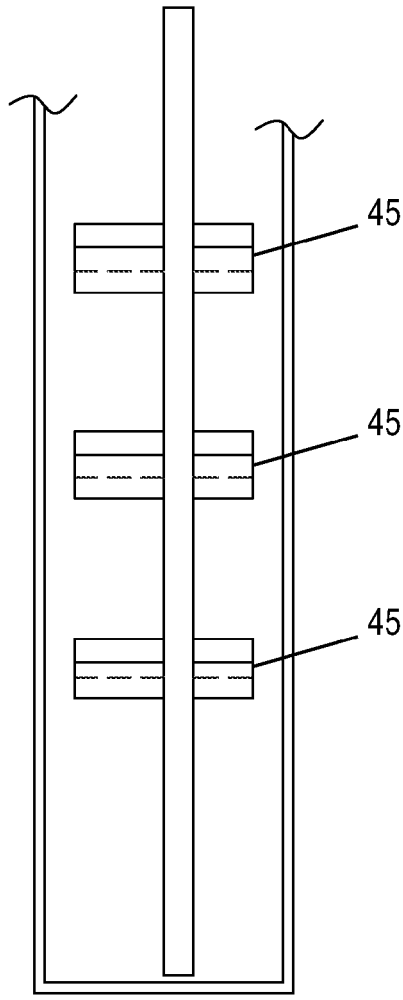
FIG. 11 is side view of the plow of FIG. 10 positioned in a cross section view of the trough.
Figure 12:
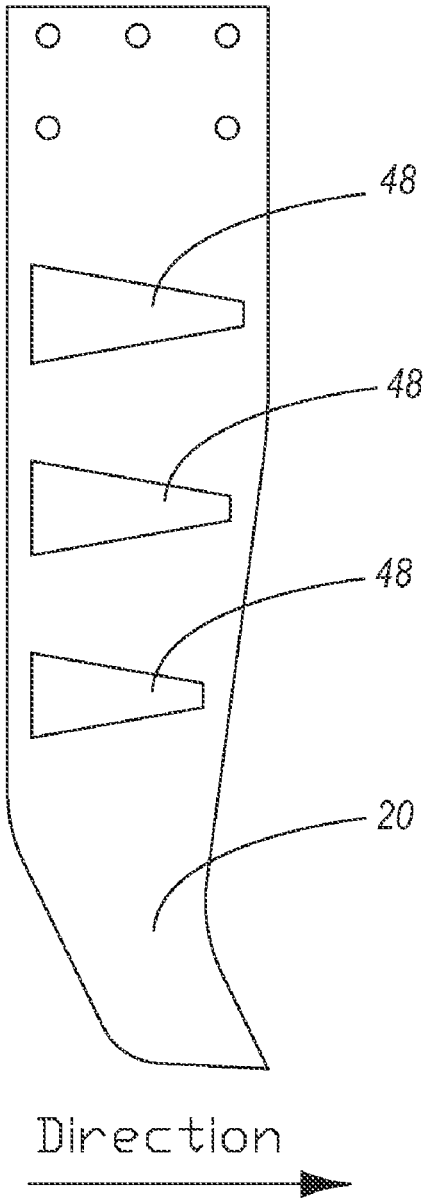
FIG. 12 is a side view of one plow of this invention with wedge shaped vanes.
Figure 13:
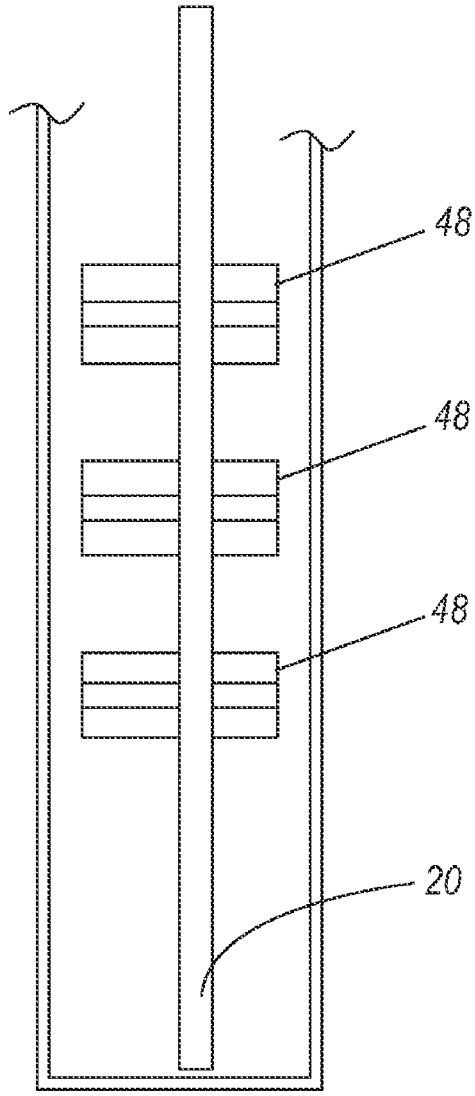
FIG. 13 is side view of the plow of FIG. 12 positioned in a cross section view of the trough.

Further compression can result from guide vanes or bars 40, 42 or 48 on either side of the grinding plow 20 to increase the grinding pressure at any desired point on the grinding plow, because such vanes compress material between the vanes or against the trough bottom 16 or top 30 (depending on whether the vanes are angled up or down. More specifically, the broad face grinding plows 20 can be equipped with the following combinations:

(1) straight bars 40 or 42 (illustrated in FIGS. 8-11) can be located on either or both sides of the grinding plow 20. These bars 40 or 42 can be adjustable to change the angle between them and the vertical axis of the plow 20. For instance, by setting the leading edge 44 of the bar 40 lower than the trailing edge 46, bar 40 will lift the media and feed material and drop it off the trailing bar edge 46. This keeps all the material in the grinding trough more fluid and results in much better grinding on sticky materials. Similarly, straight bars 45 can be positioned as shown in FIGS. 10 and 11 with the leading edge 47 higher than the trailing edge 49 so that the bars 45 will force the media and feed material down in the trough 18.

(2) Wedge shaped bars 48 on either or both sides of plow 20 increase the pressure between the bars 48 on the media and material to be ground. Since fine grinding is accomplished in the trough mill 10 of this invention at lower speeds than those used by conventional media mills, heat generated is decreased, therefore, less auxiliary cooling is required to maintain low temperatures on sensitive materials.

Two types of cooling may be used on the trough mill 10 of this invention:

(1) As may be seen in FIGS. 4, 5, 6 and 7 an outer water jacket 32 may be located on the outside of outer grinding chamber wall 14, and an inner water jacket 34 may be located on the outside of the inner grinding chamber wall 12 (within the circle defined by the inner wall 12).

(2) Cooling air can be injected into the bottom 16 of the grinding trough 18 through pipe 36 coupled to manifolds 38. Cooling by air injection is also beneficial because, by controlling air volume, sweep air can be provided to remove ground particles faster, thereby reducing residence time and preventing over-grinding when a narrow particle distribution is desired.

Numerous modifications in and variations of this invention can be made without departing from the spirit of the invention. For instance (and without limitation), differently shaped plows and vanes can be used, and different lifting structure can be used, as can different grinding chamber or trough structure and shapes, provided that an appropriately shaped trough is provided having walls close to the moving paddles, vanes or other moving structures. While the sort of tube-within-a-tube, flat bottom, flat top structures illustrated in the drawings and described above provide excellent grinding chambers, chambers in accordance with this invention could be elongated straight troughs or troughs having other shapes among other alternatives.

The grinding mills of this invention can be produced in embodiments having a wide variety of different dimensions. Among many other possible dimensions, the separation between grinding chamber walls can be on the order of approximately 10 or 12 inches with plows having faces of approximately the same width. Other dimensions are also appropriate depending on the grinding material and media in use.

Similarly, rather than rotating plows within the grinding chamber, the grinding chamber could be rotated relative to stationary plows, achieving the same relative movement between (a) the grinding chamber and materials and media and (b) the plows.

The invention claimed is:

1. A media grinding mill comprising:
(a) a grinding chamber comprising a circular trough with stationary inner and outer vertical walls connected to a trough bottom; and
(b) at least one plow having two faces disposed vertically within the trough to travel in a circular path between the walls.

2. The media grinding mill of claim 1, further comprising: a rotatable hub, centrally positioned relative to the trough, to which hub the at least one plow is attached.

3. The media grinding mill of claim 2, wherein the at least one plow comprises a plurality of plows, and further comprising a spider intermediate the plows and the hub and to which each of the hub and the plows attaches.

4. The grinding mill of claim 1, further comprising an inner water jacket, located within the inner wall.

5. The grinding mill of claim 1, further comprising an outer water jacket, located adjacent to the outer wall.

6. The grinding mill of claim 1, wherein the plow has a leading edge, and the leading edge is rotated in.

7. The grinding mill of claim 1, wherein the plow has a leading edge, and the leading edge is rotated out.

8. The grinding mill of claim 1, further comprising structure for injecting cooling air into the grinding chamber.

9. The grinding mill of claim 1, wherein a width of the plow faces is approximately equal to a distance separating the inner and outer walls.

10. A media grinding mill comprising:
(a) a grinding chamber comprising a circular trough with inner and outer vertical walls; and
(b) at least one plow having two faces disposed vertically within the trough to travel in a circular path between the walls and at least one guide vane attached to at least one face of the plow.

11. The grinding mill of claim 10, wherein the at least one guide vane comprises one guide vane attached to each of the two faces of the plow.

12. The grinding mill of claim 11, wherein the two guide vanes are attached to the plow immediately opposite each other.

13. The grinding mill of claim 10, wherein the guide vane is tilted.

14. The grinding mill of claim 10, wherein the guide vane is wedge shaped.

15. The grinding mill of claim 10, wherein the at least one guide vane comprises a plurality of guide vanes.

16. A media grinding mill comprising:
(a) a grinding chamber comprising
(i) a stationary round, tubular inner wall of a first diameter,
(ii) a stationary larger diameter outer wall connected to the inner wall by
(iii) a bottom,
creating an open space between the inner and outer walls; and
(b) at least one plow within the chamber to travel in a circular path in the open space between the walls.

17. A media grinding mill comprising:
(a) a grinding chamber comprising
(i) a round, tubular, stationary inner wall of a first diameter, (ii) a larger diameter, stationary outer wall connected to the inner wall by (iii) a bottom, creating an open space having a grinding chamber width between the inner and outer walls; and (b) a plurality of plows, each having a width comparable to the grinding chamber width and extending into the chamber to travel in a circular path in the space between the walls.

18. A media grinding mill comprising:

(a) a grinding chamber comprising (i) a round, tubular inner wall of a first diameter, (ii) a larger diameter outer wall connected to the inner wall by (iii) a bottom, creating an open space having a grinding chamber width between the inner and outer walls; and (b) a plurality of plows, each having a width comparable to the grinding chamber width and extending into the chamber to travel in a circular path in the space between the walls and a plurality of tilted guide vanes attached to at least one face of each of the plows.

19. A method of grinding material in a grinding mill using media comprising:

(a) providing:

a grinding chamber comprising a circular trough with stationary inner and outer vertical walls connected to each other by a trough bottom; and (ii) at least one plow disposed vertically within the trough, (b) charging the mill with media and material to be ground, and (c) passing the at least one plow through the media and material in a circular path within the chamber, thereby producing at least one compression region within the media and material between the plow and at least one of the vertical walls as the plow travels through the chamber and engages the media and material.

* * * * *